US006102111A

United States Patent [19]

Kamio et al.

[11] Patent Number: 6,102,111

[45] Date of Patent: Aug. 15, 2000

[54] HEAT EXCHANGER

[75] Inventors: Junichi Kamio; Tadashi Tsunoda, both of Wako, Japan

[73] Assignee: Honda Giken Kogyo Kabushiki Kaisha, Tokyo, Japan

[21] Appl. No.: 09/269,738

[22] PCT Filed: Oct. 17, 1997

[86] PCT No.: PCT/JP97/03779

§ 371 Date: Apr. 5, 1999

§ 102(e) Date: Apr. 5, 1999

[87] PCT Pub. No.: WO98/16787

PCT Pub. Date: Apr. 23, 1998

[30] Foreign Application Priority Data

Oct. 17, 1996 [JP] Japan ..... 8-275057

[51] Int. Cl.[7] ..... F28D 9/00

[52] U.S. Cl. ..... 165/165; 165/DIG. 355; 165/DIG. 399

[58] Field of Search ..... 165/165, DIG. 355, 165/DIG. 399, 166

[56] References Cited

U.S. PATENT DOCUMENTS

| | | |
|---|---|---|
| 3,265,129 | 8/1966 | Bawabe . |
| 4,582,126 | 4/1986 | Corey . |
| 5,065,816 | 11/1991 | Darragh . |

FOREIGN PATENT DOCUMENTS

| | | | |
|---|---|---|---|
| 1208367 | 2/1960 | France | 165/165 |
| 57-500945 | 5/1982 | Japan . | |
| 58-205091 | 11/1983 | Japan . | |
| 4-82857 | 7/1992 | Japan . | |
| 616184 | 1/1949 | United Kingdom | 165/165 B |
| WO 81/02060 | 7/1981 | WIPO . | |
| WO98/33033 | 7/1998 | WIPO . | |

*Primary Examiner*—Allen Flanigan
*Attorney, Agent, or Firm*—Arent Fox Kintner Plotkin & Kahn, PLLC

[57] ABSTRACT

In the case where a partition for partitioning a combustion gas passage inlet 11 from an air passage outlet 16 is defined by a plate 8 attached by brazing to end surfaces of a plurality of heat-transfer plates S1, S2 in a heat exchanger 2, durability of the brazed portions are prevented from being degraded due to a load F acting on the plate 8 by a pressure differential between a combustion gas and air. Thus a bonding base plate 26 is attached by brazing to the end surfaces of the heat-transfer plates S1, S2 with the front surface of the bonding base plate 26 brazed to the rear surface of a bonding flange 28, which is formed by bending an end of the plate 8 by right angles, and a bonding flange 27 having an L-shaped cross section is attached by brazing to an underside of the plate 8 and the front surface of the bonding base plate 26. Accordingly, the bonded portions are increased in rigidity to ease stress concentration, thus enhancing durability.

2 Claims, 13 Drawing Sheets

HEAT EXCHANGER

FIELD OF THE INVENTION

The present invention relates to a heat exchanger including high-temperature fluid passages and low-temperature fluid passages defined alternately by folding a plurality of first heat-transfer plates and a plurality of second heat-transfer plates in a zigzag fashion.

BACKGROUND ART

Heat exchangers described in Japanese Utility Model Application Laid-open No.4-82857 and Japanese Patent Application Laid-open No.58-205091 are known which include a plurality of heat-transfer plates disposed in parallel at a predetermined distance, and plates are brazed to end faces of the heat-transfer plates to define fluid passages.

When partition walls for partitioning combustion gas passage inlets and outlets from air passage outlets and inlets are formed by the plates brazed to the end surfaces of the heat-transfer plates, a load is applied to the plates due to a pressure differential between a combustion gas and air. For this reason, there is a possibility that a stress may be concentrated on brazed portions of the plates and the end surfaces of the heat-transfer plates, resulting in a reduced durability.

DISCLOSURE OF THE INVENTION

The present invention has been accomplished with the above circumstances in view, and it is an object of the present invention to avoid that the stress is concentrated on the bonded portions of end surfaces of the heat-transfer plates, thereby enhancing the durability.

To achieve the above object, according to a first aspect and feature of the present invention, there is provided a heat exchanger which is formed from a folding plate blank comprising a plurality of first heat-transfer plates and a plurality of second heat-transfer plates which are alternately connected together through first and second folding lines, the folding plate blank being folded in a zigzag fashion along the first and second folding lines, so that a gap between adjacent ones of the first folding lines is closed by bonding the first folding lines and a first end plate to each other, while a gap between adjacent ones of the second folding lines is closed by bonding the second folding lines and a second end plate, whereby high-temperature and low-temperature fluid passages are defined alternately between adjacent ones of the first and second heat-transfer plates, and in which opposite ends of each of the first and second heat-transfer plates in a flowing direction are cut into angle shapes each having two end edges, and a high-temperature fluid passage inlet is defined by closing one of the two end edges and opening the other end edge at one end of the high-temperature fluid passage in the flowing direction, while a high-temperature fluid passage outlet is defined by closing one of the two end edges and opening the other end edge at the other end of the high-temperature fluid passage in the flowing direction and further, a low-temperature fluid passage inlet is defined by opening one of the two end edges and closing the other end edge at the other end of the low-temperature fluid passage in the flowing direction, while a low-temperature fluid passage outlet is defined by opening one of the two end edges and closing the other end edge at one end of the low-temperature fluid passage in the flowing direction, and a partition plate is bonded to an apex of the angle shape at one end in the flowing direction to partition the high-temperature fluid passage inlet from the low-temperature fluid passage outlet, while a partition plate is bonded to an apex of the angle shape at the other end in the flowing direction to partition the low-temperature fluid passage inlet from the high-temperature fluid passage outlet, characterized in that bonded portions of the apex of the angle shape at the one end in the flowing direction with the partition plate and/or bonded portions of the apex of the angle shape at the other end in the flowing direction with the partition plate are comprised of a pair of bonding flanges which are brought into surface contact with and integrally bonded to a bonding base plate, the pair of bonding flanges being bifurcated from an end of the partition plate extending in the flowing direction and extending in a direction perpendicular to the flowing direction, and the bonding base plate being disposed in the direction perpendicular to the flowing direction and bonded to the apex.

With the above arrangement, if a load due to a pressure differential is applied to the partition plate of which opposite sides are contacted with a low-temperature fluid of high-pressure and a high-temperature fluid of low-pressure, a stress is concentrated on the bonded portions of the partition plate and the apex of the angle shape. However, the bonded portions can withstand the stress concentration, because the rigidity of the bonded portions is enhanced by a structure in which the bonding base plate disposed in the direction perpendicular to the flowing direction and bonded to the apex is brought into surface contact with and integrally bonded to the pair of bonding flanges which are bifurcated from the end of the partition plate extending in the flowing direction and which extend in the direction perpendicular to the flowing direction. Incidentally, in the invention defined in claim 1, the bonding base plate, the bonding flanges and/or the partition plate may be formed from one member or different members.

According to a second aspect and feature of the present invention, in addition to the first feature, the partition plate, the bonding base plate and at least one of the bonding flanges are formed from one member.

With the above arrangement, since the partition plate, the bonding base plate and at least one of the bonding flanges are formed from one member, as compared with the case where they are formed from different members and bonded to each other, the number of bonding steps is decreased, and moreover, the rigidity of the bonded portions can be increased.

BRIEF DESCRIPTION OF THE DRAWINGS

FIGS. 1 to 12 show a first embodiment of the present invention, wherein

FIG. 1 is a side view of an entire gas turbine engine;

FIG. 2 is a sectional view taken along a line 2—2 in FIG. 1;

FIG. 3 is an enlarged sectional view taken along a line 3—3 in FIG. 2 (a sectional view of combustion gas passages);

FIG. 4 is an enlarged sectional view taken along a line 4—4 in FIG. 2 (a sectional view of air passages);

FIG. 5 is an enlarged sectional view taken along a line 5—5 in FIG. 3, and FIG. 5A is an enlarged view of a portion of FIG. 5;

FIG. 6 is an enlarged sectional view taken along a line 6—6 in FIG. 3;

FIG. 7 is a developed view of a folding plate blank;

FIG. 8 is a perspective view of an essential portion of a heat exchanger;

FIG. 9 is a pattern view showing flows of a combustion gas and air;

FIG. 12 is an enlarged view of a portion indicated by 12 in FIG. 3;

BEST MODE FOR CARRYING OUT THE INVENTION

A mode for carrying out the present invention will now be described by way of embodiments with reference to the accompanying drawings.

Figure 1:
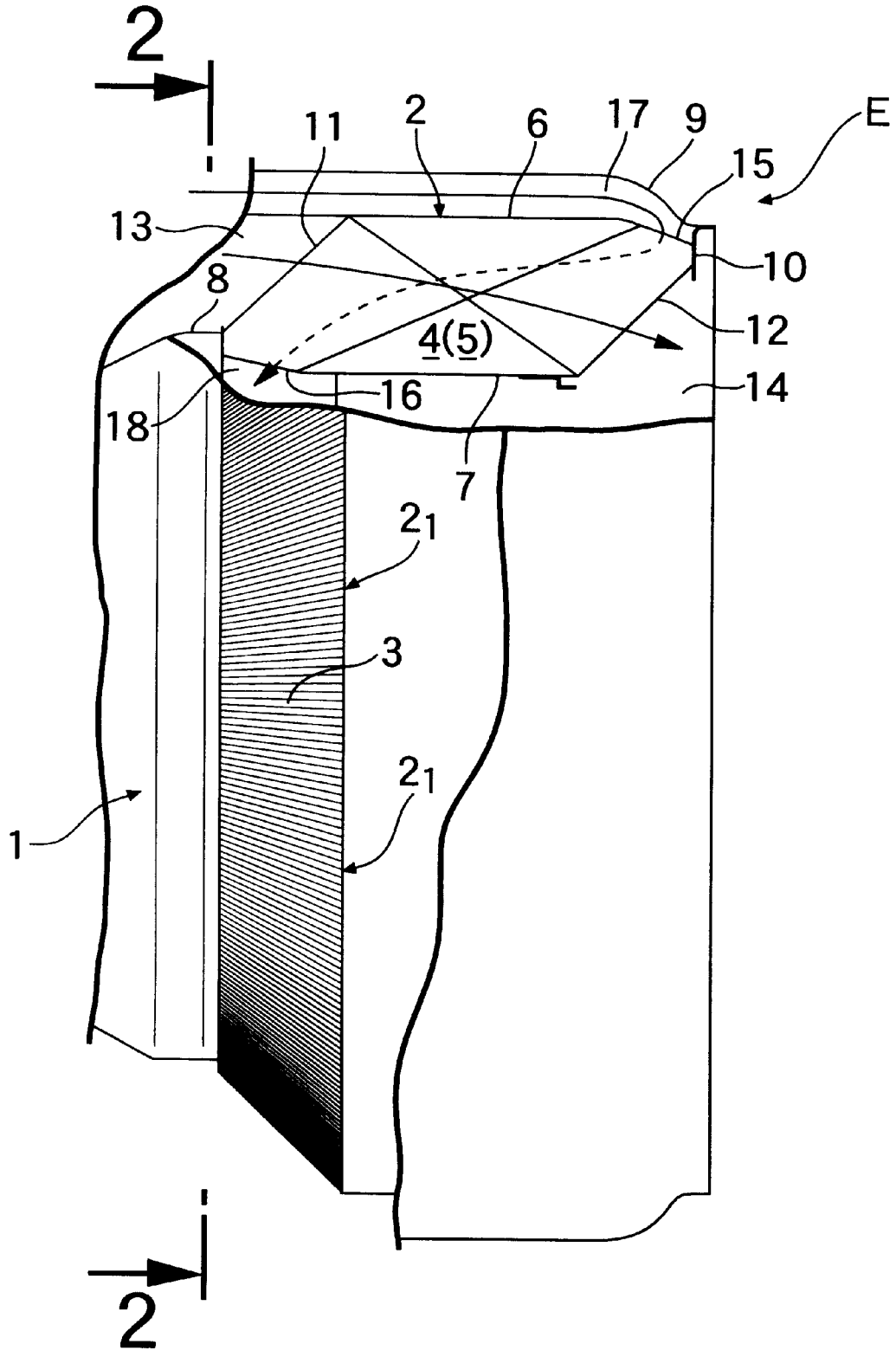
Figure 2:
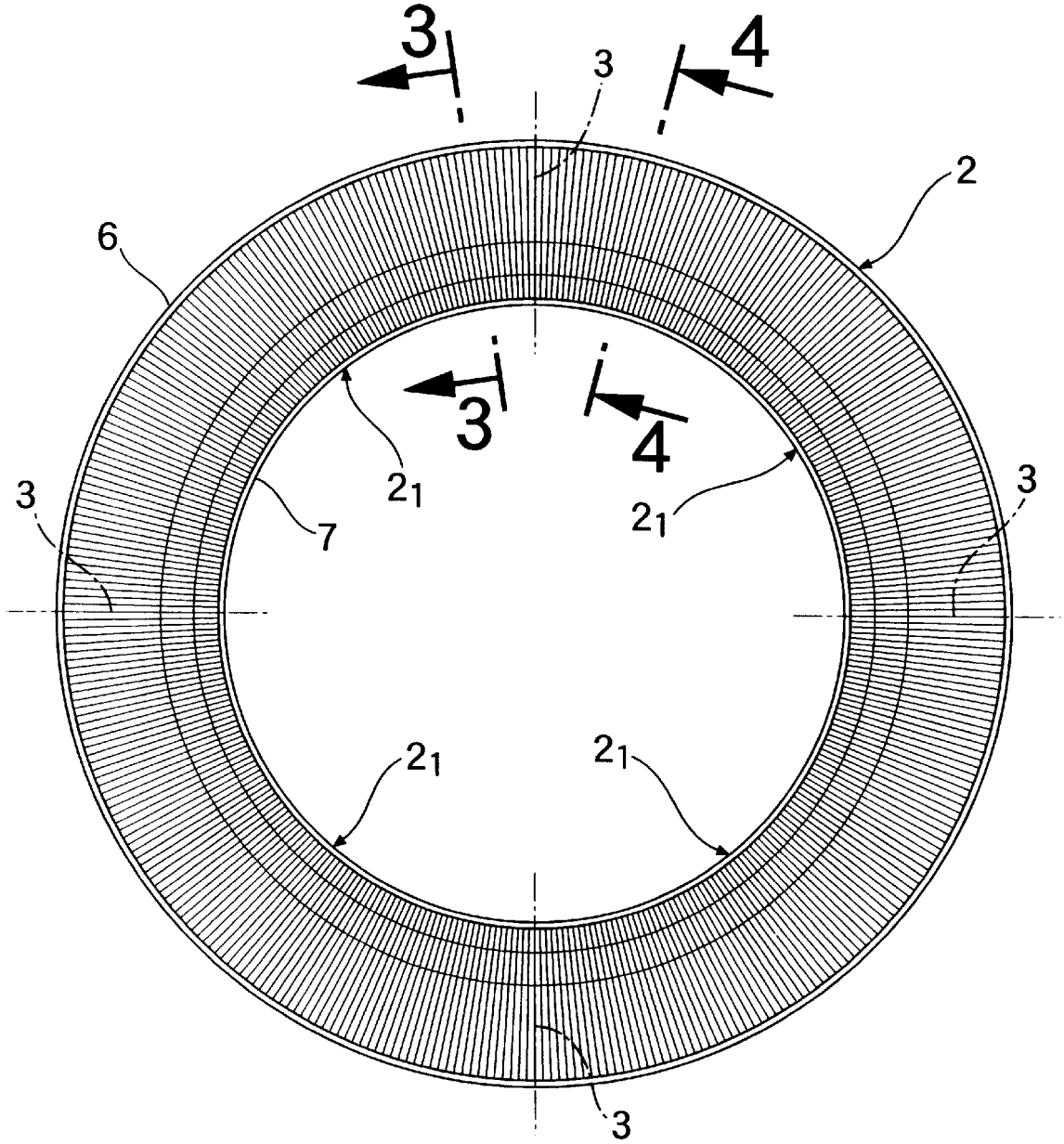

As shown in FIGS. 1 and 2, a gas turbine engine E includes an engine body 1 in which a combustor, a compressor, a turbine and the like (which are not shown) are accommodated. An annular-shaped heat exchanger 2 is disposed to surround an outer periphery of the engine body 1. The heat exchanger 2 comprises four modules $\mathbf{2}_1$ having a center angle of 90° and arranged in a circumferential direction with bond surfaces 3 interposed therebetween. Combustion gas passages 4 and air passages 5 are circumferentially alternately provided in the heat exchanger 2 (see FIGS. 5 and 6), so that a combustion gas of a relative high temperature passed through turbine is passed through the combustion gas passages 4, and air of a relative low temperature compressed in the compressor is passed through the air passages 5. A section in FIG. 1 corresponds to the combustion gas passages 4, and the air passages 5 are defined adjacent this side and the other side of the combustion gas passages 4.

The sectional shape of the heat exchanger 2 taken along an axis is an axially longer and radially shorter flat hexagonal shape. A radially outer peripheral surface of the heat exchanger 2 is closed by a larger-diameter cylindrical outer casing 6, and a radially inner peripheral surface of the heat exchanger 2 is closed by a smaller-diameter cylinder inner casing 7. A front end side (a left side in FIG. 1) in the section of the heat exchanger 2 is cut into an unequal-length angle shape, and an end plate 8 connected to an outer periphery of the engine body 1 is brazed to an end surface corresponding to an apex of the angle shape. A rear end side (a right side in FIG. 1) in the section of the heat exchanger 2 is cut into an unequal-length angle shape, and an end plate 10 connected to a rear outer housing 9 is brazed to an end surface corresponding to an apex of the angle shape.

Each of the combustion gas passages 4 in the heat exchanger 2 includes a combustion gas passage inlet 11 and a combustion gas passage outlet 12 at the left and upper portion and the right and lower portion of FIG. 1, respectively. A combustion gas introducing space (referred to as a combustion gas introducing duct) 13 defined along the outer periphery of the engine body 1 is connected at its downstream end to the combustion gas passage inlet 11. A combustion gas discharging space (referred to as a combustion gas discharging duct) 14 extending within the engine body 1 is connected at its upstream end to the combustion gas passage outlet 12.

Each of the air passages 5 in the heat exchanger 2 includes an air passage inlet 15 and an air passage outlet 16 at the right and upper portion and the left and lower portion of FIG. 1, respectively. An air introducing space (referred to as an air introducing duct) 17 defined along an inner periphery of the rear outer housing 9 is connected at its downstream end to the air passage inlet 15. An air discharging space (referred to as an air discharging duct) 18 extending within the engine body 1 is connected at its upstream end to the air passage outlet 16.

Figure 3:
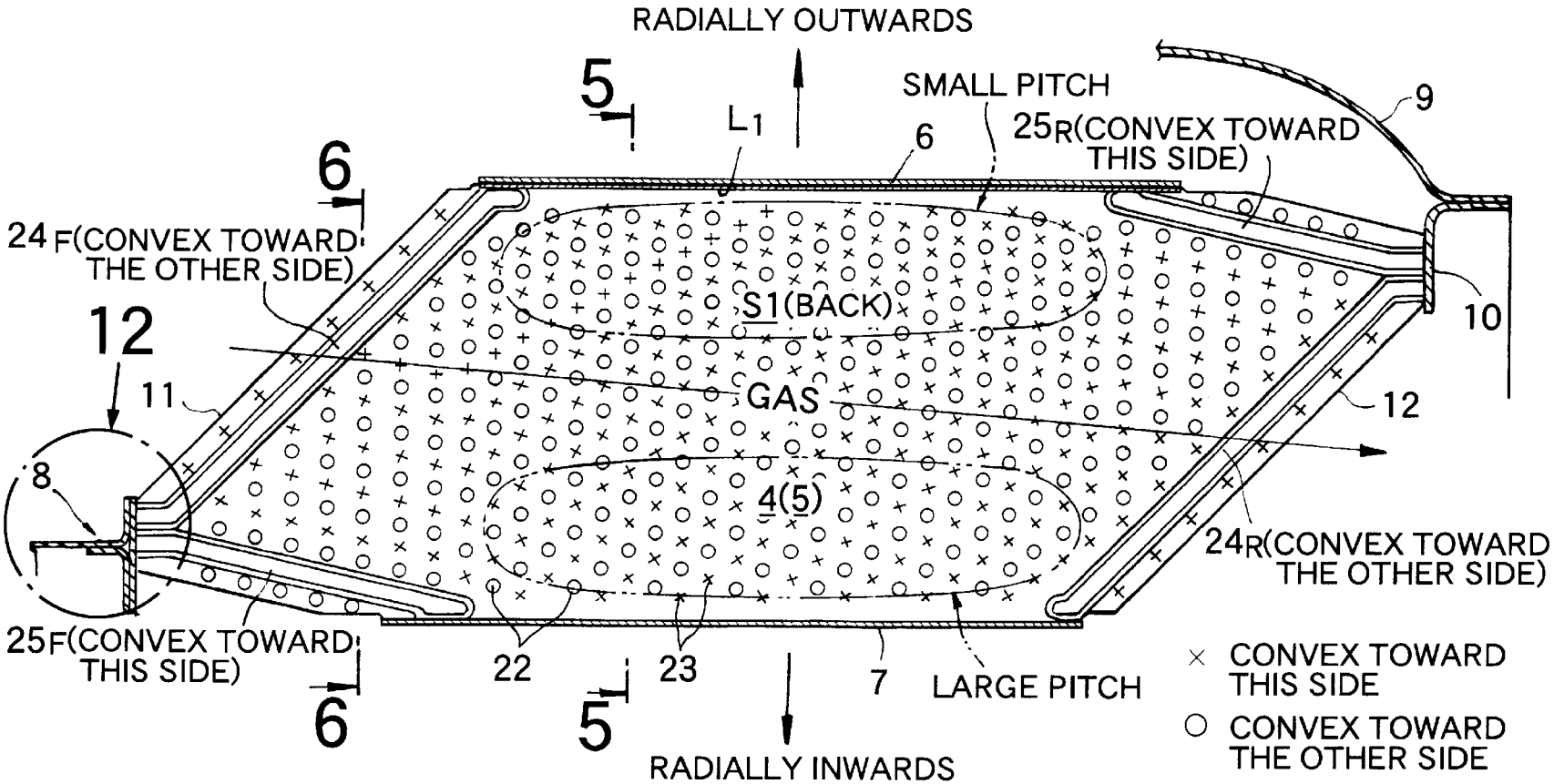
Figure 4:
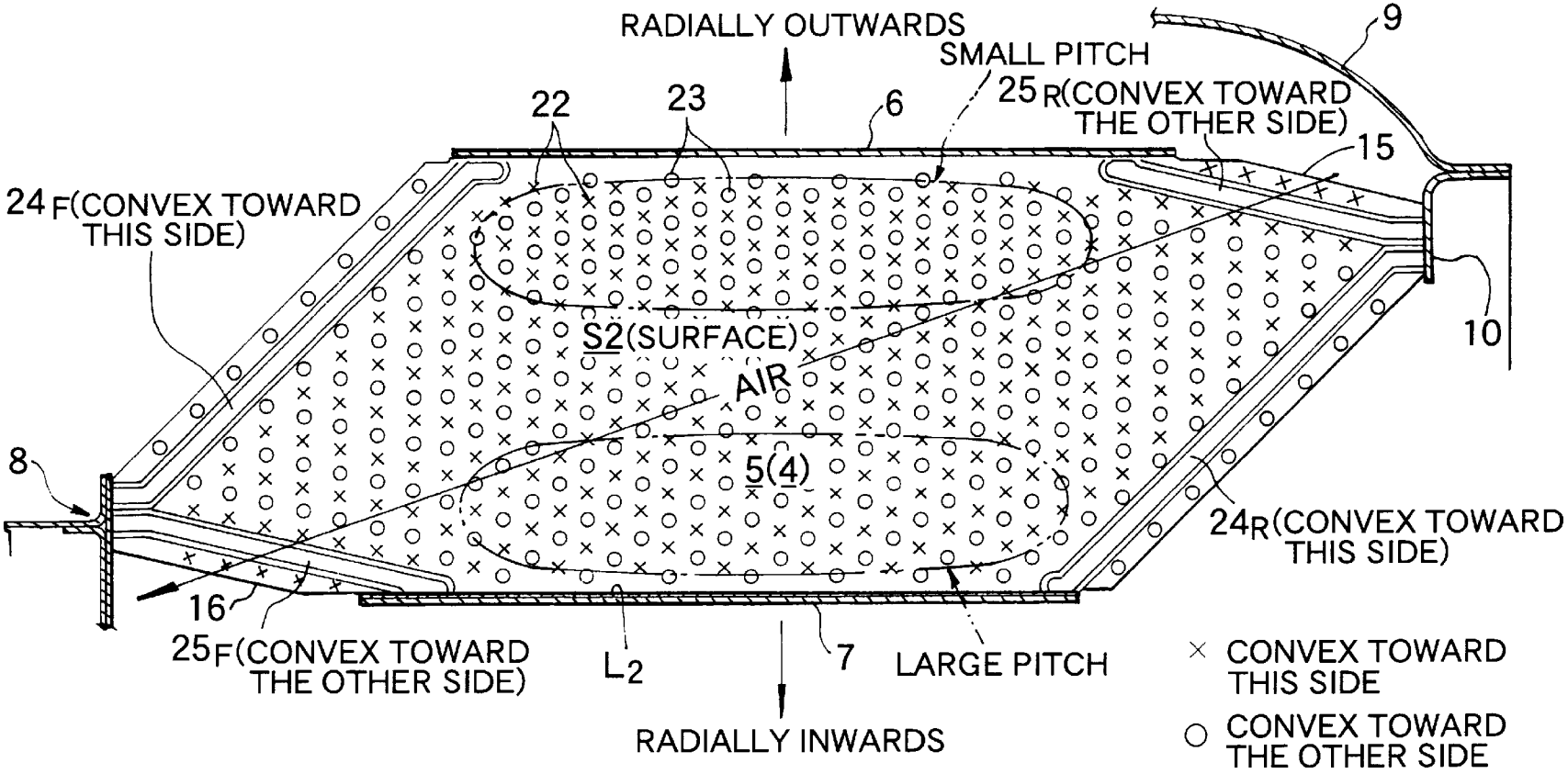
Figure 9:
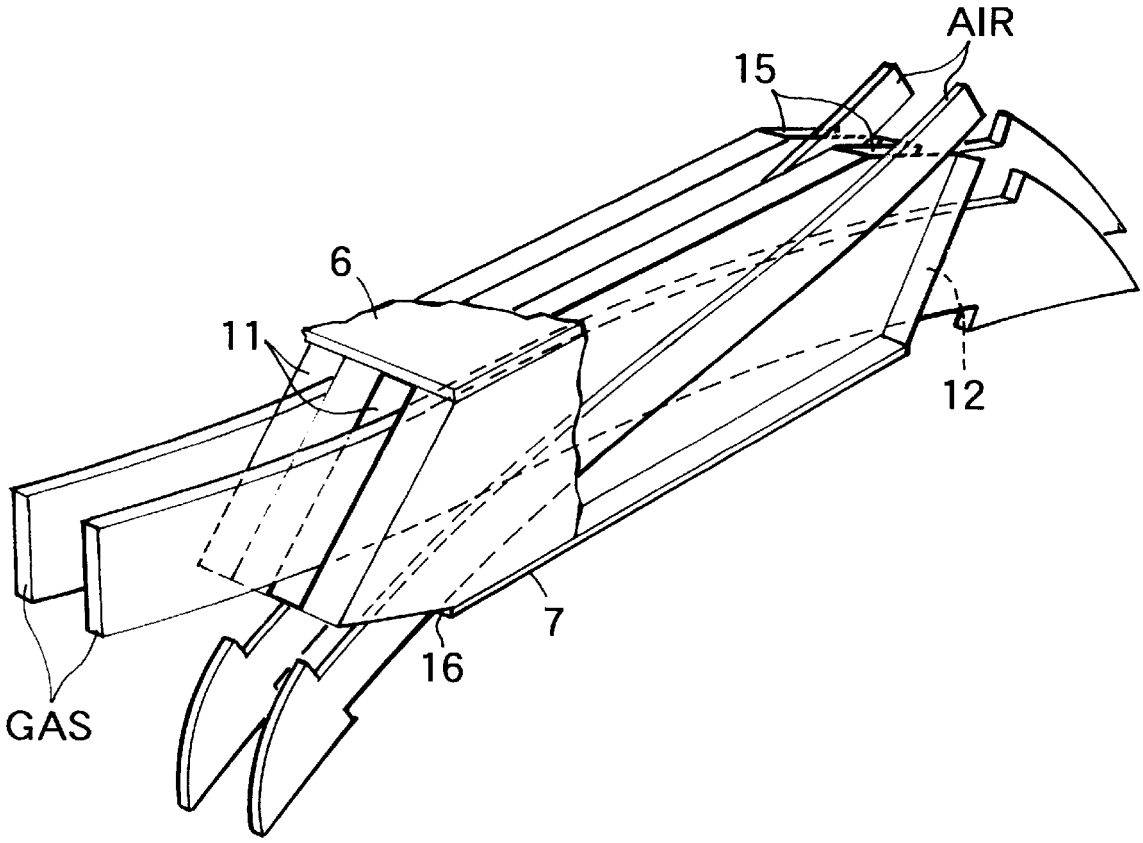

In this manner, the combustion gas and the air flow in opposite directions from each other and cross each other as shown in FIGS. 3, 4 and 9, whereby a counter flow and a so-called cross-flow are realized with a high heat-exchange efficiency. Thus, by allowing a high-temperature fluid and a low-temperature fluid to flow in opposite directions from each other, a large difference in temperature between the high-temperature fluid and the low-temperature fluid can be maintained over the entire length of the flow paths, thereby enhancing the heat-exchange efficiency.

The temperature of the combustion gas which has driven the turbine is about 600 to 700° C. in the combustion gas passage inlets 11. The combustion gas is cooled down to about 300 to 400° C. in the combustion gas passage outlets 12 by conducting a heat-exchange between the combustion gas and the air when the combustion gas passes through the combustion gas passages 4. On the other hand, the temperature of the air compressed by the compressor is about 200 to 300° C. in the air passage inlets 15. The air is heated up to about 500 to 600° C. in the air passage outlets 16 by conducting a heat-exchange between the air and the combustion gas, which occurs when the air passes through the air passages 5.

The structure of the heat exchanger 2 will be described below with reference to FIGS. 3 to 8.

Figure 7:
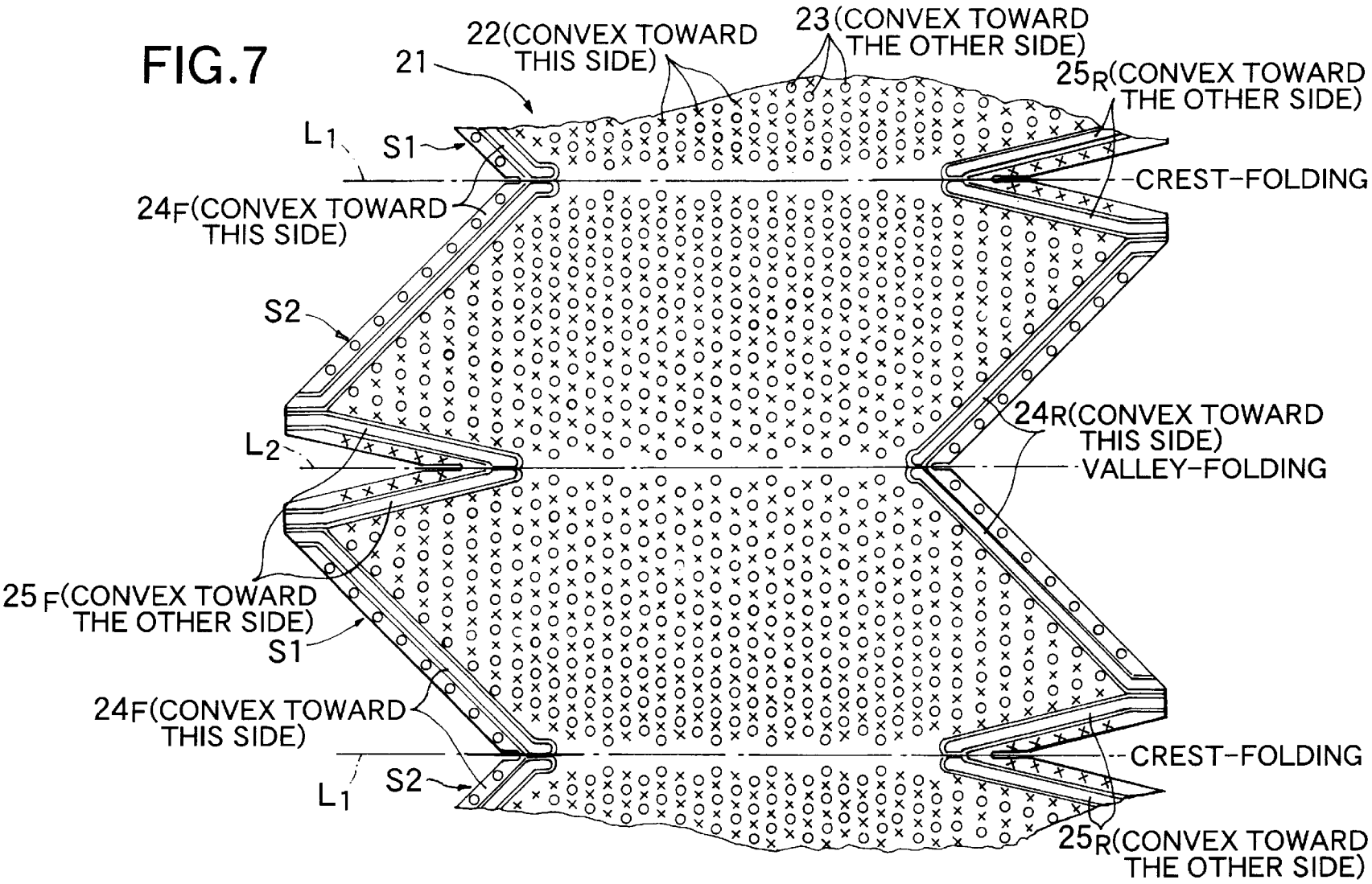
Figure 8:
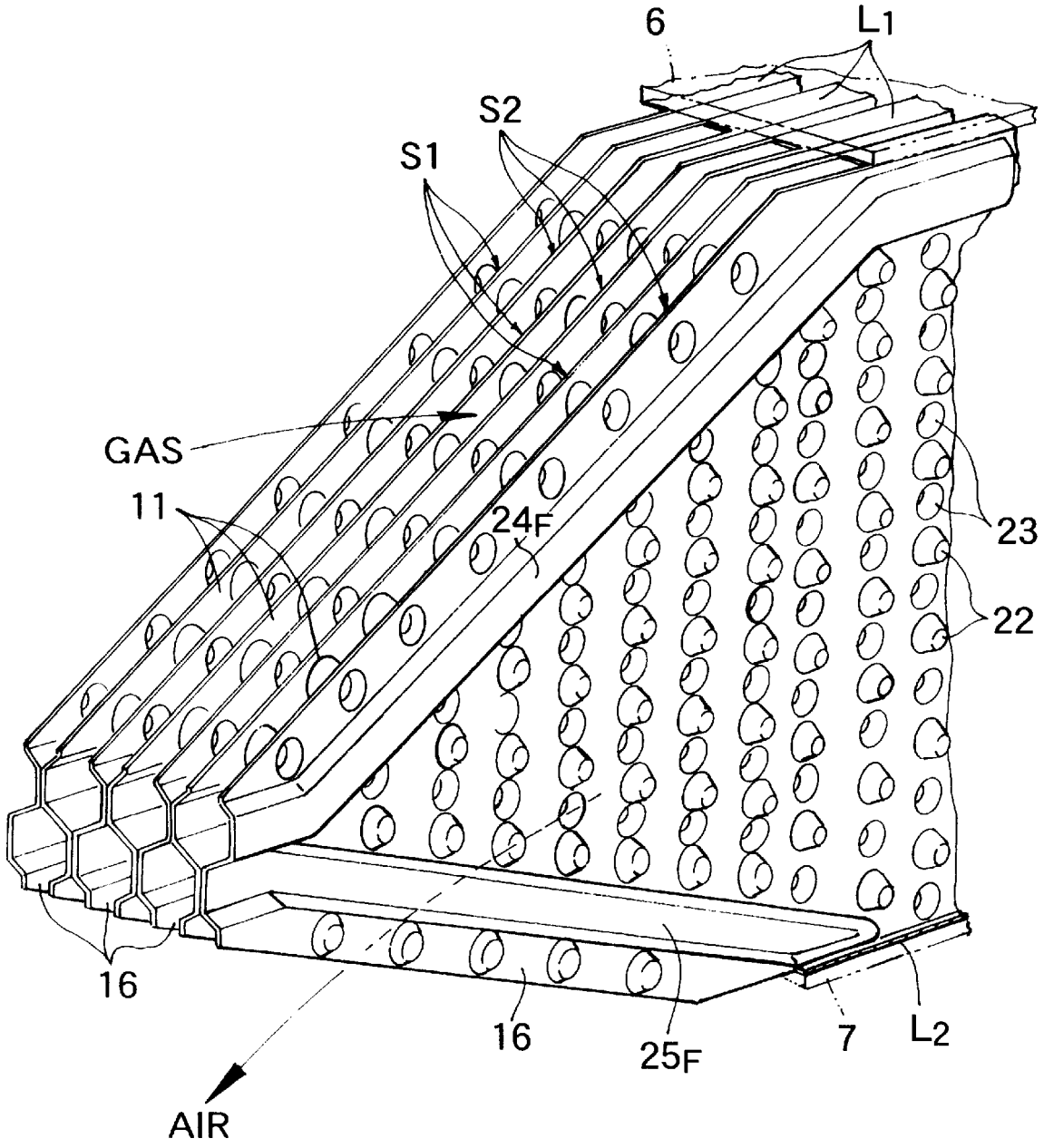

As shown in FIGS. 3, 4 and 7, each of the modules $\mathbf{2}_1$ of the heat exchanger 2 is made from a folding plate blank 21 produced by previously cutting a thin metal plate such as a stainless steel into a predetermined shape and then forming an irregularity on a surface of the cut plate by pressing. The folding plate blank 21 is comprised of first heat-transfer plates S1 and second heat-transfer plates S2 disposed alternately, and is folded into a zigzag fashion along crest-folding lines $L_1$ and valley-folding lines $L_2$. The term "crest-folding" means folding into a convex toward this side or a closer side from the drawing sheet surface, and the term "valley-folding" means folding into a convex toward the other side or a far side from the drawing sheet surface. Each of the crest-folding lines $L_1$ and the valley-folding lines $L_2$ is not a simple straight line, but actually comprises an arcuate folding line or two parallel and adjacent folding lines for the purpose of forming a predetermined space between each of the first heat-transfer plates S1 and each of the second heat-transfer plates S2.

A large number of first projections 22 and a large number of second projections 23, which are disposed at unequal distances, are formed on each of the first and second heat-transfer plates S1 and S2 by pressing. The first projections 22 indicated by a mark X in FIG. 7 protrude toward this side on the drawing sheet surface of FIG. 7, and the second projections 23 indicated by a mark O in FIG. 7 protrude toward the other side on the drawing sheet surface of FIG. 7. The first and second projections 22 and 23 are arranged alternately (i.e., so that the first projections 22 are not continuous to one another and the second projections 23 are not continuous to one another).

First projection stripes $\mathbf{24}_F$ and second projection stripes $\mathbf{25}_F$ are formed by pressing at those front and rear ends of the first and second heat-transfer plates S1 and S2 which are cut into the angle shape. The first projection stripes $\mathbf{24}_F$ protrude toward this side on the drawing sheet surface of FIG. 7, and the second projection stripes $\mathbf{25}_F$ protrude toward the other side on the drawing sheet surface of FIG. 7. In any of the first and second heat-transfer plates S1 and S2, a pair of the front and rear first projection stripes $\mathbf{24}_F$, $\mathbf{24}_R$ are disposed at diagonal positions, and a pair of the front and rear second projection stripes $\mathbf{25}_F$, $\mathbf{25}_R$ are disposed at other diagonal positions.

The first projections 22, the second projections 23, the first projection stripes $\mathbf{24}_F$, $\mathbf{24}_R$ and the second projection stripes $\mathbf{25}_F$, $\mathbf{25}_R$ of the first heat-transfer plate S1 shown in FIG. 3 are in an opposite recess-projection relationship with respect to that in the first heat-transfer plate S1 shown in FIG. 7. This is because FIG. 3 shows a state in which the first heat-transfer plate S1 is viewed from the back side.

Figures 5, 5A:
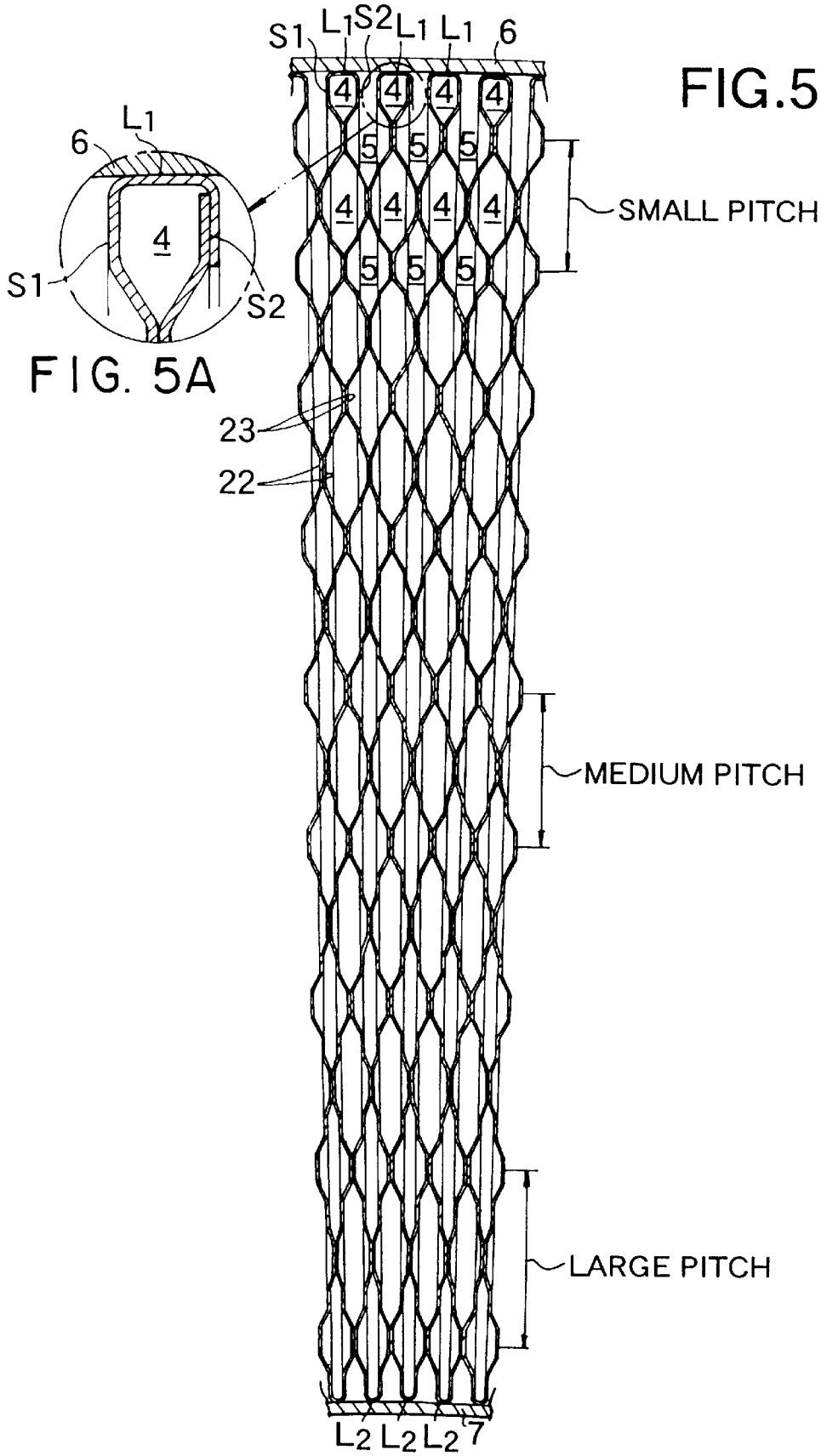
Figure 6:
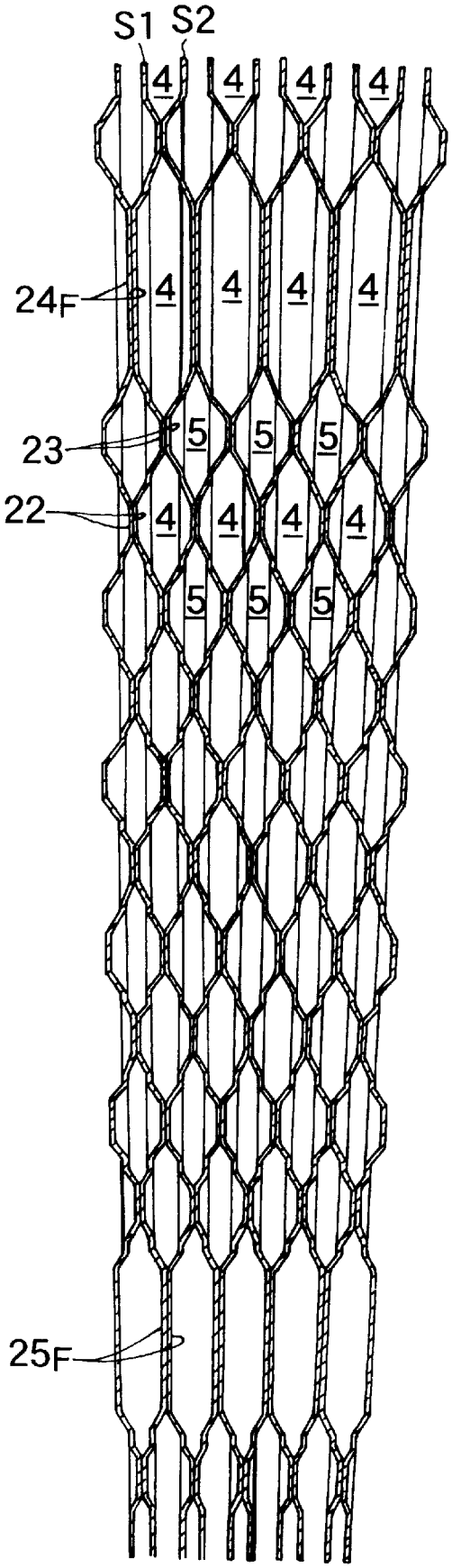

As can be seen from FIGS. 5 to 7, when the first and second heat-transfer plates S1 and S2 of the folding plate blank 21 are folded along the crest-folding lines $L_1$ to form the combustion gas passages 4 between both the heat-transfer plates S1 and S2, tip ends of the second projections 23 of the first heat-transfer plate S1 and tip ends of the second projections 23 of the second heat-transfer plate S2 are brought into abutment against each other and brazed to each other. In addition, the second projection stripes $\mathbf{25}_F$, $\mathbf{25}_R$ of the first heat-transfer plate S1 and the second projection stripes $\mathbf{25}_F$, $\mathbf{25}_R$ of the second heat-transfer plate S2 are brought into abutment against each other and brazed to each other. Thus, a left lower portion and a right upper portion of the combustion gas passage 4 shown in FIG. 3 are closed, and each of the first projection stripes $\mathbf{24}_F$, $\mathbf{24}_R$ of the first heat-transfer plate S1 and each of the first projection stripes $\mathbf{24}_F$, $\mathbf{24}_R$ of the second heat-transfer plate S2 are opposed to each other with a gap left therebetween. Further, the combustion gas passage inlet 11 and the combustion gas passage outlet 12 are defined in a left, upper portion and a right, lower portion of the combustion gas passage 4 shown in FIG. 3, respectively.

When the first heat-transfer plates S1 and the second heat-transfer plates S2 of the folding plate blank 21 are folded along the valley-folding line $L_2$ to form the air passages 5 between both the heat-transfer plates S1 and S2, the tip ends of the first projections 22 of the first heat-transfer plate S1 and the tip ends of the first projections 22 of the second heat-transfer plate S2 are brought into abutment against each other and brazed to each other. In addition, the first projection stripes $\mathbf{24}_F$, $\mathbf{24}_R$ of the first heat-transfer plate S1 and the first projection stripes $\mathbf{24}_F$, $\mathbf{24}_R$ of the second heat-transfer plate S2 are brought into abutment against each other and brazed to each other. Thus, a left upper portion and a right lower portion of the air passage 5 shown in FIG. 4 are closed, and each of the second projection stripes $\mathbf{25}_F$, $\mathbf{25}_R$ of the first heat-transfer plate S1 and each of the second projection stripes $\mathbf{25}_F$, $\mathbf{25}_R$ of the second heat-transfer plate S2 are opposed to each other with a gap left therebetween. Further, the air passage inlet 15 and the air passage outlet 16 are defined at a right upper portion and a left lower portion of the air passage 5 shown in FIG. 4, respectively.

A state in which the air passages 5 have been closed by the first projection stripes $\mathbf{24}_F$ is shown in an upper portion (a radially outer portion) of FIG. 6, a state in which the combustion gas passages 4 have been closed by the second projection stripes $\mathbf{25}_F$ is shown in a lower portion (a radially outer portion) of FIG. 6.

Each of the first and second projections 22 and 23 has a substantially truncated conical shape, and the tip ends of the first and second projections 22 and 23 are in surface contact with each other to enhance the brazing strength. Each of the first and second projection stripes $\mathbf{24}_F$, $\mathbf{24}_R$ and $\mathbf{25}_F$, $\mathbf{25}_R$ has also a substantially trapezoidal section, and the tip ends of the first and second projection stripes $\mathbf{24}_F$, $\mathbf{24}_R$ and $\mathbf{25}_F$, $\mathbf{25}_R$ are also in surface contact with each other to enhance the brazing strength.

As can be seen from FIG. 5, radially inner peripheral portions of the air passages 5 are automatically closed, because they correspond to the folded portion (the valley-folding line $L_2$) of the folding plate blank 21, but radially outer peripheral portions of the air passages 5 are opened, and such opening portions are closed by brazing to the outer casing 6. On the other hand, radially outer peripheral portions of the combustion gas passages 4 are automatically closed, because they correspond to the folded portion (the crest-folding line $L_1$) of the folding plate blank 21, but radially inner peripheral portions of the combustion gas passages 4 are opened, and such opening portions are closed by brazing to the inner casing 7.

When the folding plate blank 21 is folded in the zigzag fashion, the adjacent crest-folding lines $L_1$ cannot be brought into direct contact with each other, but the distance between the crest-folding lines $L_1$ is maintained constant by the contact of the first projections 22 to each other. In addition, the adjacent valley-folding lines $L_2$ cannot be brought into direct contact with each other, but the distance between the valley-folding lines $L_2$ is maintained constant by the contact of the second projections 23 to each other.

When the folding plate blank 21 is folded in the zigzag fashion to produce the modules $\mathbf{2}_1$ of the heat exchanger 2, the first and second heat-transfer plates S1 and S2 are disposed radiately from the center of the heat exchanger 2. Therefore, the distance between the adjacent first and second heat-transfer plates S1 and S2 assumes the maximum in the radially outer peripheral portion which is in contact with the outer casing 6, and the minimum in the radially inner peripheral portion which is in contact with the inner casing 7. For this reason, the heights of the first projections 22, the second projections 23, the first projection stripes $\mathbf{24}_F$, $\mathbf{24}_R$ and the second projection stripes $\mathbf{25}_F$, $\mathbf{25}_R$ are gradually increased outwards from the radially inner side, whereby the first and second heat-transfer plates S1 and S2 can be disposed exactly radiately (see FIGS. 5 and 6).

By employing the above-described structure of the radiately folded plates, the outer casing 6 and the inner casing 7 can be positioned concentrically, and the axial symmetry of the heat exchanger 2 can be maintained accurately.

By forming the heat exchanger 2 by a combination of the four modules $\mathbf{2}_1$ having the same structure, the manufacture of the heat exchanger can be facilitated, and the structure of the heat exchanger can be simplified. In addition, by folding the folding plate blank 21 radiately and in the zigzag fashion to continuously form the first and second heat-transfer plates S1 and S2, the number of parts and the number of brazing points can remarkably be decreased, and moreover, the dimensional accuracy of a completed article can be enhanced, as compared with a case where a large number of first heat-transfer plates S1 independent from one another and a large number of second heat-transfer plates S2 independent from one another are brazed alternately.

As can be seen from FIG. 5, when the modules $\mathbf{2}_1$ of the heat exchanger 2 are bonded to one another at the bond surfaces 3 (see FIG. 2), end edges of the first heat-transfer plates S1 folded into a J-shape beyond the crest-folding line $L_1$ and end edges of the second heat-transfer plates S2 cut rectilinearly at a location short of the crest-folding line $L_1$ are superposed on each other and brazed to each other. By employing the above-described structure, a special bonding member for bonding the adjacent modules $2_1$ to each other is not required, and a special processing for changing the thickness of the folding plate blank 21 is not required. Therefore, the number of parts and the processing cost are reduced, and further an increase in heat mass in the bonded zone is avoided. Moreover, a dead space which is neither the combustion gas passages 4 nor the air passages 5 is not created and hence, the increase in flow path resistance is suppressed to the minimum, and there is not a possibility that the heat exchange efficiency may be reduced.

During operation of the gas turbine engine E, the pressure in the combustion gas passages 4 is relatively low, and the pressure in the air passages 5 is relatively high. For this reason, a flexural load is applied to the first and second heat-transfer plates S1 and S2 due to a difference between the pressures, but a sufficient rigidity capable of withstanding such load can be obtained by virtue of the first and second projections 22 and 23 which have been brought into abutment against each other and brazed with each other.

In addition, the surface areas of the first and second heat-transfer plates S1 and S2 (i.e., the surface areas of the combustion gas passages 4 and the air passages 5) are increased by virtue of the first and second projections 22 and 23. Moreover, the flows of the combustion gas and the air are agitated and hence, the heat exchange efficiency can be enhanced.

Figure 12:
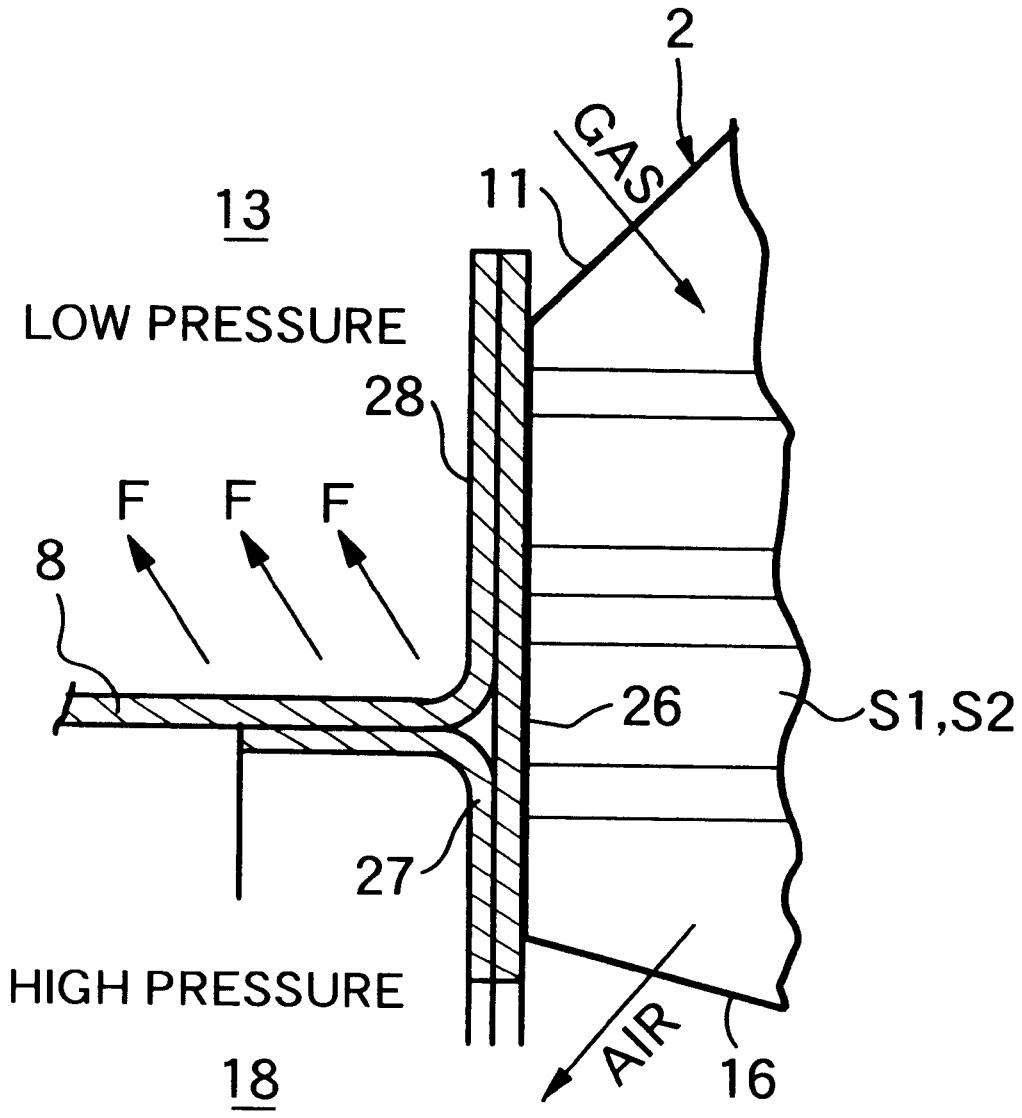

As shown in FIG. 12, a bonding base plate 26 formed annularly is brazed at its rear surface to an angle-cut apex of the heat exchanger 2. The end plate 8 is integrally provided at its rear end with a bonding flange 28 which is curved radially outwards, and a rear surface of the bonding flange 28 is brought into surface contact with and brazed to a front surface of the bonding base plate 26. A rear surface of a bonding flange 27 formed into an L-shape in section is also brought into surface contact with and brazed to the front surface of the bonding base plate 26, and an upper surface of the bonding flange 27 is brought into surface contact with and brazed to a lower surface of the end plate 8 at its rear end.

Bonded portions of the end plate 8 and the angle-shaped apex of the heat exchanger 2 are reinforced by the bonding base plate 26 and the two bonding flanges 27 and 28. Therefore, even if a load in the direction of an arrow F is applied to the end plate 8 due to a pressure differential between the higher-pressure air and the lower-pressure combustion gas, the stress concentration to the bonded portions can be moderated to enhance the durability. In this case, the stress concentration can be further effectively moderated by providing bend portions of the two bonding flanges 27 and 28 with a sufficiently large radius of curvature.

The unit amount $N_{tu}$ of heat transfer representing the amount of heat transferred between the combustion gas passages 4 and the air passages 5 is given by the following equation (1):

$$N_{tu}=(K\times A)/[C\times(dm/dt)] \quad (1)$$

In the above equation (1), K is an overall heat transfer coefficient of the first and second heat-transfer plates S1 and S2; A is an area (a heat-transfer area) of the first and second heat-transfer plates S1 and S2; C is a specific heat of a fluid; and dm/dt is a mass flow rate of the fluid flowing in the heat transfer area. Each of the heat transfer area A and the specific heat C is a constant, but each of the overall heat transfer coefficient K and the mass flow rate dm/dt is a function of a pitch P (see FIG. 5) between the adjacent first projections 22 or between the adjacent second projections 23.

When the unit amount $N_{tu}$ of heat transfer is varied in the radial directions of the first and second heat-transfer plates S1 and S2, the distribution of temperature of the first and second heat-transfer plates S1 and S2 is non-uniformed radially, resulting in a reduced heat exchange efficiency, and moreover, the first and second heat-transfer plates S1 and S2 are non-uniformly, thermally expanded radially to generate undesirable thermal stress. Therefore, if the pitch P of radial arrangement of the first and second projections 22 and 23 is set suitably, so that the unit amount $N_{tu}$ of heat transfer is constant in radially various sites of the first and second heat-transfer plates S1 and S2, the above problems can be overcome.

Figure 10A:
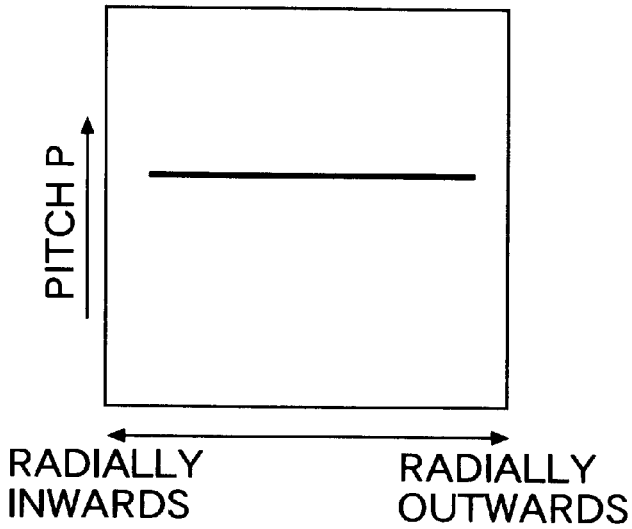
FIGS. 10A, 10B and 10C are graphs for explaining the operation when the pitch of projections is uniformized.
Figure 10B:
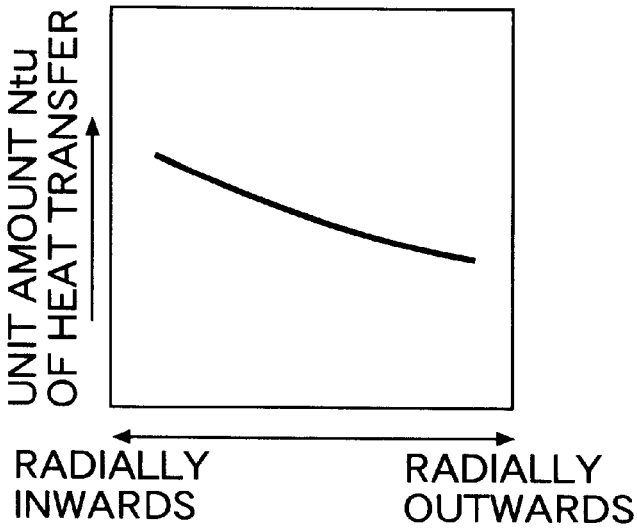
Figure 10C:
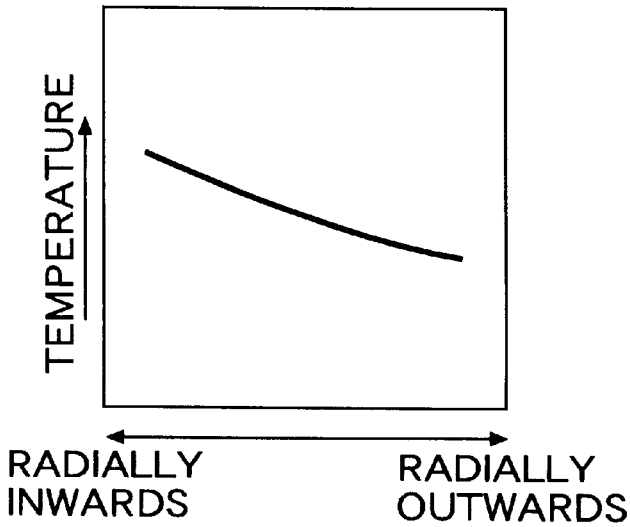
Figure 11A:
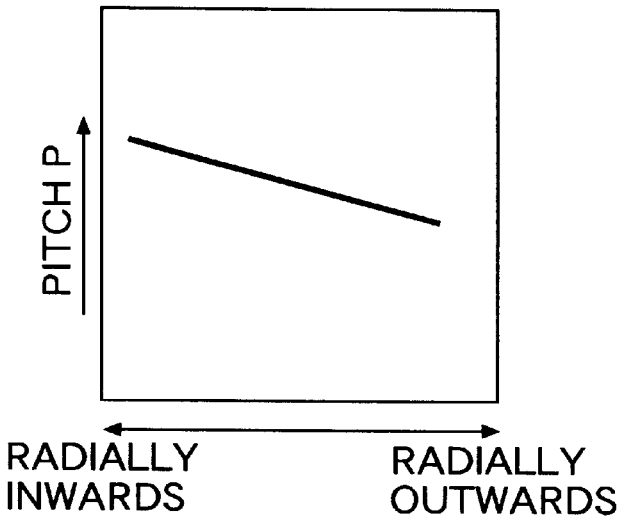
FIGS. 11A, 11B and 11C are graphs for explaining the operation when the pitch of projections is non-uniformed.
Figure 11B:
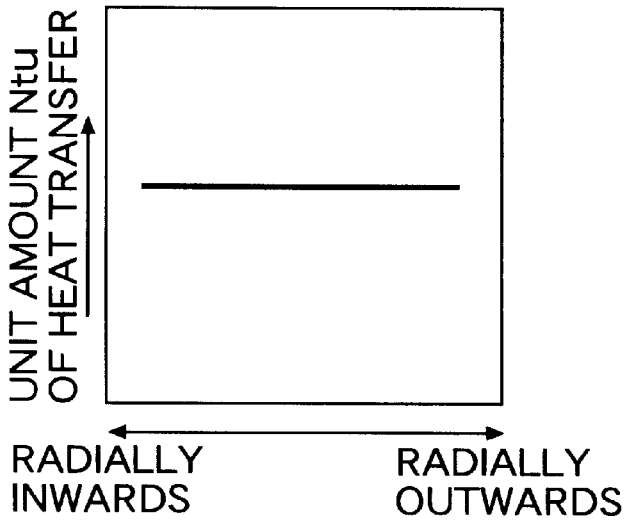
Figure 11C:
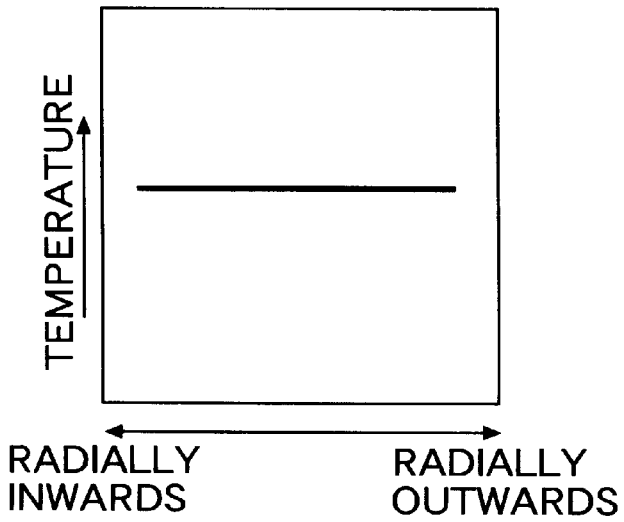

When the pitch P is set constant in the radial directions of the heat exchanger 2, as shown in FIG. 10A, the unit amount $N_{tu}$ of heat transfer is larger at the radially inner portion and smaller at the radially outer portion, as shown in FIG. 10B. Therefore, the distribution of temperature of the first and second heat-transfer plates S1 and S2 is also higher at the radially inner portion and lower at the radially outer portion, as shown in FIG. 10C. On the other hand, if the pitch P is set so that it is larger in the radially inner portion of the heat exchanger 2 and smaller in the radially outer portion of the heat exchanger 2, as shown in FIG. 11A, the unit amount $N_{tu}$ of heat transfer and the distribution of temperature can be made substantially constant in the radial directions, as shown in FIGS. 11B and 11C.

As can be seen from FIGS. 3 to 5, in the heat exchanger 2 according to this embodiment, a region having a larger pitch P of radial arrangement of the first and second projections 22 and 23 is provided in the radially inner portion of the heat exchanger 2, and a region having a smaller pitch P of radial arrangement of the first and second projections 22 and 23 is provided in the radially outer portion of the heat exchanger 2. Thus, the unit amount $N_{tu}$ of heat transfer can be made substantially constant over the entire region of the first and second heat-transfer plates S1 and S2, and it is possible to enhance the heat exchange efficiency and to alleviate the thermal stress.

If the entire shape of the heat exchanger and the shapes of the first and second projections 22 and 23 are varied, the overall heat transfer coefficient K and the mass flow rate dm/dt are also varied and hence, the suitable arrangement of pitches P is also different from that in the present embodiment. Therefore, in addition to a case where the pitch P is gradually decreased radially outwards as in the present embodiment, the pitch P may be gradually increased radially outwards in some cases. However, if the arrangement of pitches P is determined such that the above-described equation (1) is established, the operational effect can be obtained irrespective of the entire shape of the heat exchanger and the shapes of the first and second projections 22 and 23.

As can be seen from FIGS. 3 and 4, the first and second heat-transfer plates S1 and S2 are cut into an unequal-length angle shape having a long side and a short side at the front and rear ends of the heat exchanger 2. The combustion gas passage inlet 11 and the combustion gas passage outlet 12 are defined along the long sides at the front and rear ends, respectively, and the air passage inlet 15 and the air passage outlet 16 are defined along the short sides at the rear and front ends, respectively.

In this way, the combustion gas passage inlet 11 and the air passage outlet 16 are defined respectively along the two sides of the angle shape at the front end of the heat exchanger 2, and the combustion gas passage outlet 12 and the air passage inlet 15 are defined respectively along the two sides of the angle shape at the rear end of the heat exchanger 2. Therefore, larger sectional areas of the flow paths in the inlets 11, 15 and the outlets 12, 16 can be ensured to suppress the pressure loss to the minimum, as compared with a case where the inlets 11, 15 and the outlets 12, 16 are defined without cutting of the front and rear ends of the heat exchanger 2 into the angle shape. Moreover, since the inlets 11, 15 and the outlets 12, 16 are defined along the two sides of the angle shape, not only the flow paths for the combustion gas and the air flowing out of and into the combustion gas passages 4 and the air passages 5 can be smoothened to further reduce the pressure loss, but also the ducts connected to the inlets 11, 15 and the outlets 12, 16 can be disposed in the axial direction without sharp bending of the flow paths, whereby the radially dimension of the heat exchanger 2 can be reduced.

As compared with the volume flow rate of the air passed through the air passage inlet 15 and the air passage outlet 16, the volume flow rate of the combustion gas, which has been produced by burning a fuel-air mixture resulting from mixing of fuel into the air and expanded in the turbine into a dropped pressure, is larger. In the present embodiment, the unequal-length angle shape is such that the lengths of the air passage inlet 15 and the air passage outlet 16, through which the air is passed at the small volume flow rate, are short, and the lengths of the combustion gas passage inlet 11 and the combustion gas passage outlet 12, through which the combustion gas is passed at the large volume flow rate, are long. Thus, it is possible to relatively reduce the flow rate of the combustion gas to more effectively avoid the generation of a pressure loss.

Yet further, since the end plates 8 and 10 are brazed to the tip end surfaces of the front and rear ends of the heat exchanger 2 formed into the angle shape, the brazing area can be minimized to reduce the possibility of leakage of the combustion gas and the air due to a brazing failure. Moreover, the inlets 11, 15 and the outlets 12, 16 can simply and reliably be partitioned, while suppressing the decrease in opening areas of the inlets 11, 15 and the outlets 12, 16.

Second, third and fourth embodiments of the present invention will now be described with reference to FIG. 13.

Figure 13A:
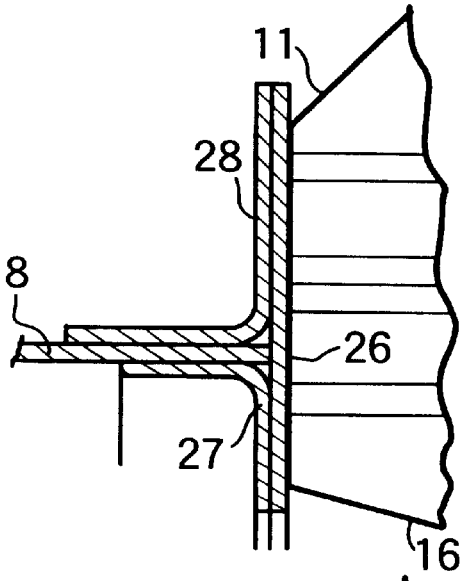
FIGS. 13A, 13B and 13C are views similar to FIG. 12, but showing second, third and fourth embodiments of the present invention.

In the second embodiment of the present invention shown in FIG. 13A, the bonding flange 28 is formed from a member separate from the end plate 8 and brazed to an upper surface of the end plate 8 at its rear end and to the front surface of the bonding base plate 26. With the second embodiment, the rear end portion of the end plate 8 is of a triple structure and hence, the rigidity of the bonded portion is further enhanced, as compared with the first embodiment.

Figure 13B:
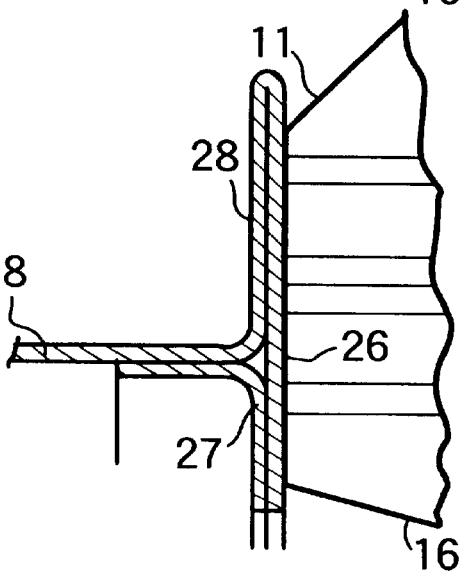
Figure 13C:
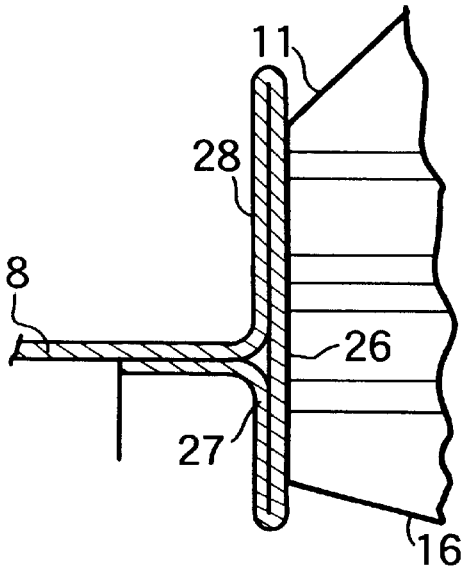

In the third embodiment of the present invention shown in FIG. 13B, one of the bonding flanges 28 and the bonding base plate 26 are formed integrally with the end plate 8. In the fourth embodiment of the present invention shown in FIG. 13C, both of the bonding flanges 27 and 28 and the bonding base plate 26 are formed integrally with the end plate 8. With the third and fourth embodiments, the number of brazing steps is, of course, decreased, and the rigidity of the bonded portions is enhanced, as compared with a case where the bonding flanges 27 and 28 and the bonding base plate 26 are brazed to the end plate 8.

Although the embodiments of the present invention have been described in detail, it will be understood that the present invention is not limited to the above-described embodiments, and various modifications in design may be made without departing from the subject matter of the invention.

For example, the present invention is applied to one of the end plates 8 in the embodiments, but may be applied to the other end plate 10 or both of the end plates 8 and 10. The heat exchanger 2 for the gas turbine engine E has been illustrated in the embodiments, but the present invention is also applicable to a heat exchanger used in another application. The present invention is not limited to the heat exchanger 2 including the first heat-transfer plates S1 and the second heat-transfer plates S2 which are disposed radiately, and is also applicable to a heat exchanger including first heat-transfer plates S1 and second heat-transfer plates S2 which are disposed in parallel.

What is claimed is:

1. A heat exchanger which is formed from a folding plate blank (21) comprising a plurality of first heat-transfer plates (S1) and a plurality of second heat-transfer plates (S2) which are alternately connected together through first and second folding lines ($L_1$ and $L_2$), said folding plate blank (21) being folded in a zigzag fashion along said first and second folding lines ($L_1$ and $L_2$), so that a gap between adjacent ones of said first folding lines ($L_1$) is closed by bonding said first folding lines ($L_1$) and a first end plate (6) to each other, while a gap between adjacent ones of said second folding lines ($L_2$)is closed by bonding said second folding lines ($L_2$) and a second end plate (7), whereby high-temperature and low-temperature fluid passages (4 and 5) are defined alternately between adjacent ones of said first and second heat-transfer plates (S1 and S2), and in which opposite ends of each of said first and second heat-transfer plates (S1 and S2) in a flowing direction are cut into angle shapes each having two end edges, and a high-temperature fluid passage inlet (11) is defined by closing one of said two end edges and opening the other end edge at one end of said high-temperature fluid passage (4) in the flowing direction, while a high-temperature fluid passage outlet (12) is defined by closing one of said two end edges and opening the other end edge at the other end of said high-temperature fluid passage (4) in the flowing direction, and further, a low-temperature fluid passage inlet (15) is defined by opening one of said two end edges and closing the other end edge at the other end of said low-temperature fluid passage (5) in the flowing direction, while a low-temperature fluid passage outlet (16) is defined by opening one of said two end edges and closing the other end edge at one end of said low-temperature fluid passage (5) in the flowing direction, and a partition plate (8) is bonded to an apex of said angle shape at one end in the flowing direction to partition said high-temperature fluid passage inlet (11) from said low-temperature fluid passage outlet (16), while a partition plate (10) is bonded to an apex of said angle shape at the other end in the flowing direction to partition said low-temperature fluid passage inlet (15) from said high-temperature fluid passage outlet (12), characterized in that bonded portions of the apex of said angle shape at said one end in the flowing direction with said partition plate (8) and/or bonded portions of the apex of the angle shape at said other end in the flowing direction with the partition plate (10) are comprised of a pair of bonding flanges (27 and 28) which are brought into surface contact with and integrally bonded to a bonding base plate (26), said pair of bonding flanges (27 and 28) being bifurcated from an end of said partition plate (8) extending in the flowing direction and extending in a direction perpendicular to the flowing direction, and said bonding base plate (26) being disposed in the direction perpendicular to the flowing direction and bonded to said apex.

2. A heat exchanger according to claim 1, characterized in that said partition plate (8), said bonding base plate (26) and at least one of said bonding flanges (27 and 28) are formed from one member.

* * * * *